US007947886B2

(12) United States Patent
Hoyle

(10) Patent No.: US 7,947,886 B2
(45) Date of Patent: May 24, 2011

(54) GUITAR SLIDE HOLDER

(75) Inventor: William Vance Hoyle, Woonsocket, RI (US)

(73) Assignee: William V Hoyle, Woonsocket, RI (US)

( * ) Notice: Subject to any disclaimer, the term of this patent is extended or adjusted under 35 U.S.C. 154(b) by 0 days.

(21) Appl. No.: 12/462,915

(22) Filed: Aug. 11, 2009

(65) Prior Publication Data

US 2011/0061511 A1 Mar. 17, 2011

(51) Int. Cl.
*G10D 3/00* (2006.01)

(52) U.S. Cl. ..... 84/315; 84/387 A
(58) Field of Classification Search ..... 84/312 R, 84/315–317
See application file for complete search history.

(56) References Cited

U.S. PATENT DOCUMENTS 7,205,467 B2 * 4/2007 Tafolla et al. ..... 84/327
* cited by examiner

*Primary Examiner* — Kimberly R Lockett

(57) ABSTRACT

This is a device that will securely store and hold a guitar slide while allowing the user to perform single-handed guitar slide transitions (installation or removal of a guitar slide) with minimal interruption.

1 Claim, 2 Drawing Sheets

GUITAR SLIDE HOLDER

BACKGROUND OF THE INVENTION

A. Field of Invention

This relates to playing a stringed musical instrument and having the means of storing and easily installing or removing a guitar slide during a performance or composition.

B. Prior Art

There are many prior art references related to guitars and the use of guitar slides. A representative example of this type of device can be found at Smith, U.S. Pat. No. 4,328,733. This is a slide bar holder device for a Hawaiian guitar. The present application does not specifically relate to Hawaiian guitars.

Another example is a guitar slide bar apparatus that can be found at de los Santos, U.S. Pat. No. 4,817,488. Again, this specifically relates to a guitar slide bar apparatus, but it is not related to the storage of that particular apparatus. An example of slide bar holder can be found at Terry, U.S. Pat. No. 5,739,445. This relates to the storage of a guitar slide on a strap, and is not related to the interactive transitions of guitar slide installation or removal. Another example of a guitar slide pouch can be found at Stroscio, U.S. Pat. No. 7,238,871. This is a completely different structure than the one in the current application. Other examples include Rosen, U.S. Pat. No. 4,790,232, Surber, U.S. Pat. No. 6,323,409, and Ward, U.S. Pat. No. 6,255,569.

The present invention alleviates the problems with the aforementioned prior art by allowing the guitar slide to be placed in a secure location, thus ending the danger of a broken or lost guitar slide. The location of this device is convenient and is defined by the user. The present invention eliminates the need for a two handed guitar slide installation or removal, as only the guitar slide hand is needed for installation or removal of the guitar slide. The present invention also enhances the users performance by allowing quick and easy installation or removal of the guitar slide.

BRIEF SUMMARY OF THE INVENTION

This is a holder for a guitar slide that allows the user to easily install or remove a guitar slide. A guitar is played by plucking the strings at the top of the guitar. Pressing a guitar slide against the strings of the instrument along the neck (above the fret board) while picking selected strings produces a desired sound. Ease of installing or removing a guitar slide in a timely manner is paramount for the performance of a guitar player.

With this device, the slide is securely stored in the apparatus in any location as defined by the user.

The user can install the guitar slide by inserting the desired playing finger into the guitar slide (captive in the device) and removing the playing finger with the guitar slide installed, from the device.

The user may remove the guitar slide by placing the guitar slide (already attached to the playing finger) into the device and remove the playing finger while the guitar slide remains captive in the device.

DETAILED DESCRIPTIONS OF THE EMBODIMENTS

Figure 1:
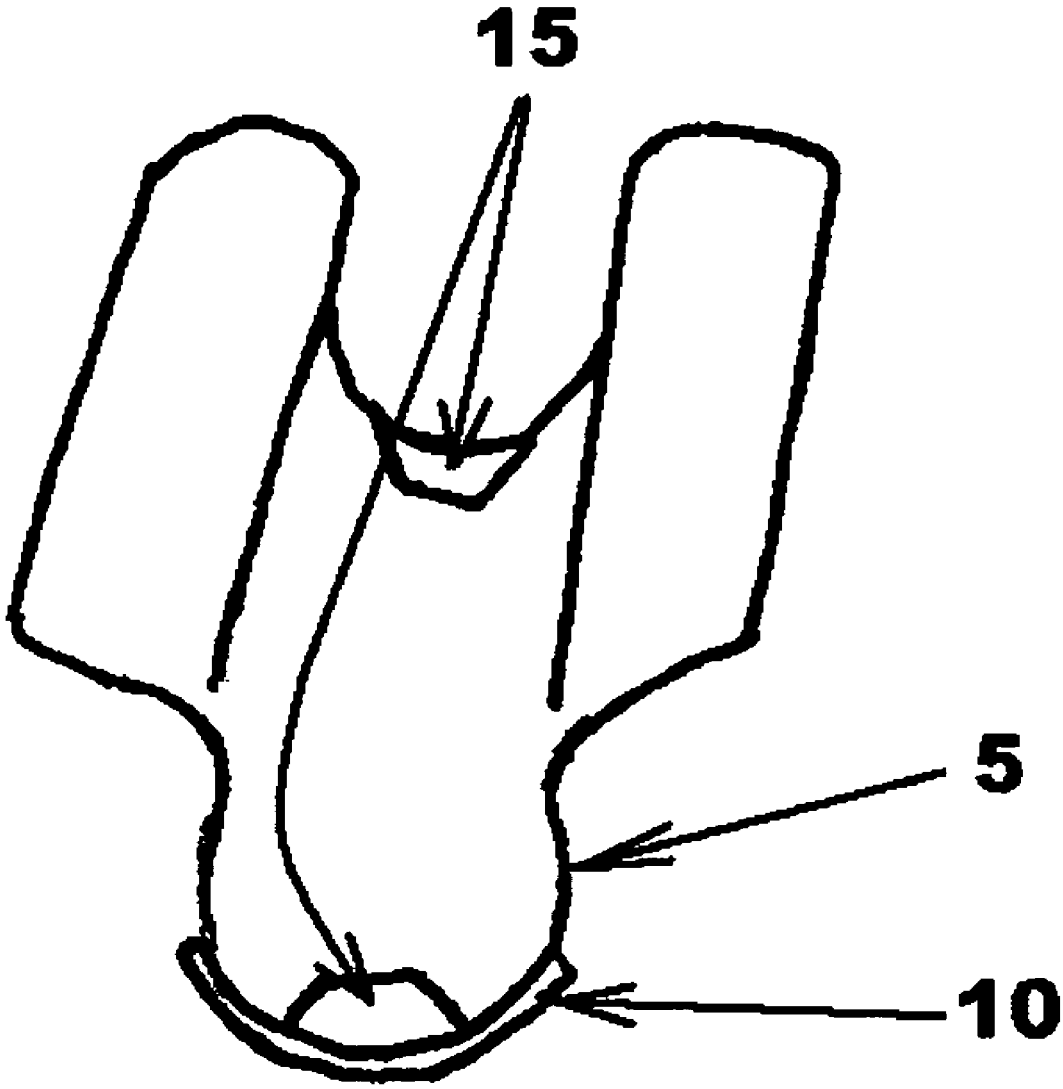
FIG. 1 is a view of the guitar slide holder.
Figure 2:
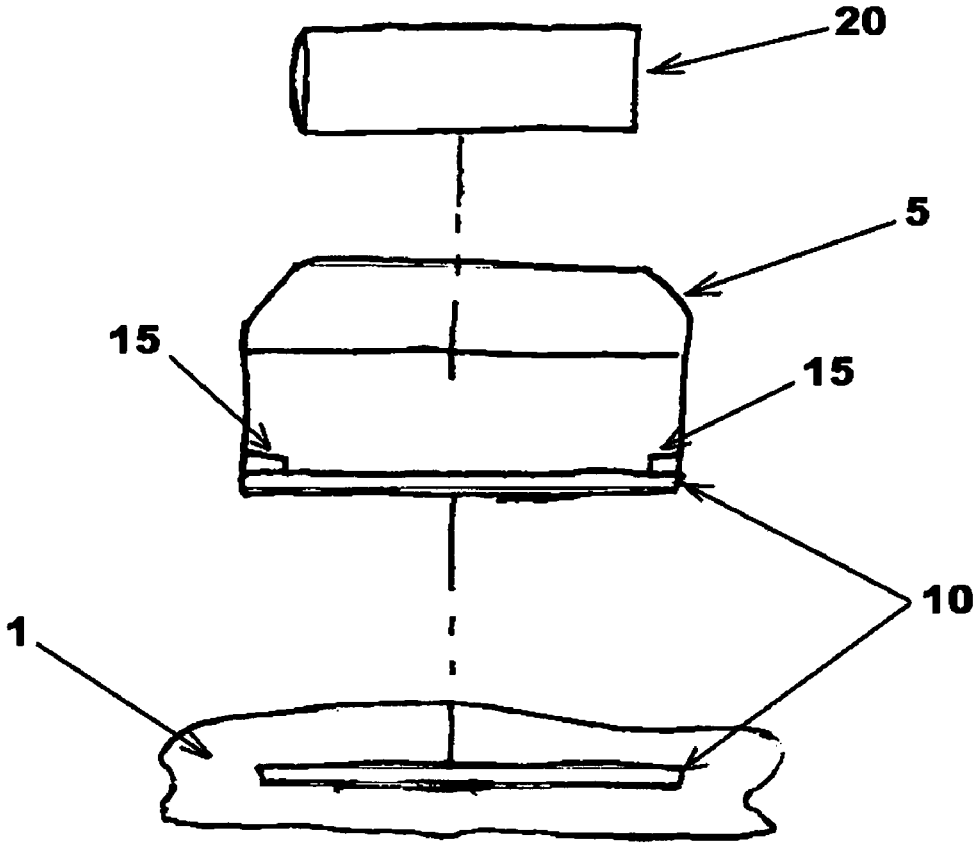
FIG. 2 is a view of the device in use.
Figure 3:
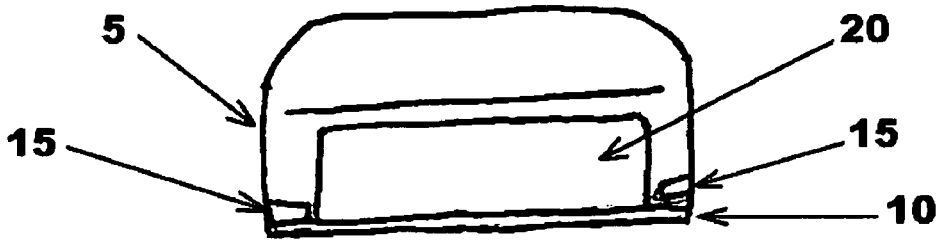
FIG. 3 is a view of a guitar slide in the guitar slide holder.

Guitar slides 20 have been in use for many years. To put on or take off a guitar slide 20 is cumbersome and time consuming often requiring two hands to perform the operation. This problem makes it difficult to employ a guitar slide 20 during a performance without creating an interruption in the user's composition. In order to accomplish both the convenience of a stored location, and the versatility of installing or removing a guitar slide 20 in a single handed quick and easy operation, this device has been devised. The guitar slide 20 is placed in a guitar slide holder 5 of a predetermined shape and size to securely embrace the guitar slide 20 within the guitar slide holder 5. FIGS. 1, 3. The guitar slide holder 5 incorporates two guitar slide retaining tabs 15 at each end of the guitar slide holder 5. The retaining tabs 15 allow the user to remove the guitar slide 20 from their playing finger while preventing the guitar slide 20 from falling out of (and thus remaining captive in) the guitar slide holder 5. FIGS. 1, 2, 3. The guitar slide holder 5 is secured to surface 1 with means of attachment being a hook and loop fastening system 10. FIG. 3. One portion of the means of attachment 10 is placed on the exterior of the guitar slide holder 5 while the second portion of the means of attachment is placed on surface 1 as defined by the user. Surface 1 may be any surface deemed convenient by the user. Examples of surfaces are, but not limited to, any part of the instrument, any part of the user's clothing, any fixed object (such as an amplifier or stand).

The inventor claims:

1. A device for a guitar slide, which is comprised of:

a. a holding apparatus;

wherein the apparatus is of predetermined dimensions;

wherein the apparatus has a first and second end;

wherein the first and second ends are open;

wherein the first and second ends have guitar slide retaining tabs;

wherein the apparatus is secured to desired location with a means of attachment;

b. a guitar slide;

wherein the guitar slide is inserted into the opening of the holding apparatus;

wherein the guitar slide is removed from the opening of the holding apparatus;

c. a means of attachment for the holding apparatus;

wherein the means of attachment has a first and second part;

said means of attachment is a hook and loop assembly;

said first part is secured to location defined by user;

said second part is secured to one side of the outside of the holding apparatus.

* * * * *